US005860616A

United States Patent [19]

Lamothe

[11] Patent Number: 5,860,616

[45] Date of Patent: Jan. 19, 1999

[54] ALTERNATIVE FEEDING FROM ROLL OR BOX INTO LASER PRINTER

[75] Inventor: Richard P. Lamothe, Burlington, Conn.

[73] Assignee: Energy Saving Products and Sales Corporation, Burlington, Conn.

[21] Appl. No.: 813,253

[22] Filed: Mar. 7, 1997

[51] Int. Cl.[6] ..... B65H 57/14; B65H 16/10; B65H 23/00

[52] U.S. Cl. ..... 242/564.1; 242/564.3; 242/566; 242/615.21

[58] Field of Search ..... 242/615.21, 566, 242/615, 615.2, 564.3, 564, 564.1

[56] References Cited

U.S. PATENT DOCUMENTS 2,212,006 8/1940 Buchanan ..... 242/615.21 X
3,206,089 9/1965 Huck ..... 242/615.21 X
3,679,116 7/1972 Hamlin et al. ..... 242/615.21 X
5,016,801 5/1991 Gilat et al. ..... 242/615.21

*Primary Examiner*—John Q. Nguyen
*Attorney, Agent, or Firm*—McCormick, Paulding & Huber

[57] ABSTRACT

A high speed printer is fed paper from either of two sources. An unwind machine provides one paper web from a paper roll directly into the printer. The second source is from a box feeder located alongside the unwind machine. The paper web, folded and stored in the box or boxes, is fed around mutually perpendicular angled rollers into the printer whenever a change over is required. The system obviates the need for physically moving both the unwind machine and the box feeder whenever a changeover is required to fulfill the needs of successive printing runs.

1 Claim, 2 Drawing Sheets

ALTERNATIVE FEEDING FROM ROLL OR BOX INTO LASER PRINTER

CROSS-REFERENCE TO RELATED APPLICATIONS

This application is related to another application entitled MACHINE FOR MANIPULATING WEB MATERIAL, patented Apr. 9, 1996, under U.S. Pat. No. 5,505,401 and to Ser. No. 488,508 filed Dec. 7, 1995, which is a continuation-in-part of U.S. Pat. No. 5,505,401. This application is also related to a copending application entitled SIDE-BY-SIDE ROLL UNWIND AND REWIND identified by Ser. No. 679,992 filed Jul. 15, 1996, being a continuation of Ser. No. 416,964 filed Apr. 5, 1995.

Both of the above-identified applications are incorporated by reference herein, and for the record, it is noted that the first above-identified application relates to a disclosure that includes a high speed laser printer having an unwind machine provided at one end to feed a paper web into the laser printer, and an unwind machine at the opposite end of the laser printer to receive the paper web after it is printed and rewinding the web into a roll in said unwind machine.

The second above-identified application relates to providing the unwind machine alongside the rewind machine and providing a frame that includes a driven torque roller forming a tension free loop for the web material at the downstream end of the printer. Further, the unwind machine has canted mutually related angled rollers for reorienting the web in order to feed the printed web through successive 90° turns so that it can be aligned with and accommodated by the rewind machine. The unwind machine is conventionally located so as to feed the paper web into the laser printer in a conventional fashion.

BACKGROUND OF THE INVENTION

Present practice in print shops that utilize high speed laser printers require that an unwind machine be replaced by a box feeder when perforated paper sheets are to be fed from boxes of folded, but connected sheets into the laser printer for printing. The perforated paper comprises a plurality of sheets integrally interconnected to one another and folded one on top of another so as to be stored in boxes. The box feeder may include suitable means for splicing the paper web from box to box, and the paper web is provided over sprockets rather than requiring the usual tension free loop as is the case with a conventional unwind machine of the type described in the above-identified application Ser. No. 218,512.

The present invention provides for the unwind machine to be left in place even when the paper web to be printed is fed from boxes into the laser printer. This result is made possible by providing a path for the perforated paper web fed from the box feeder so as to allow the web to be fed directly into the laser printer without requiring removal and replacement of the unwind machine. As a result, the downtime of the printer is minimized, and greater versatility is provided for the print shop operator in that paper web from a roll can be printed upon, or in the alternative perforated paper web from boxes can also be printed on in the same high speed laser printer.

Small print shops are generally set-up for handling perforated paper fed from a box feeder. However, such small print shops face the necessity for adapting to the feeding of paper from a roll in an unwind machine that may or may not provide for rewinding the paper on a paper roll after it is printed upon. The present invention also allows printing on paper web from a roll in the unwind machine. The paper is then fed from the laser printer after it is printed upon into a folder. Alternatively, perforated paper can be fed from a box feeder through a pair of angularly related rollers and into the laser printer for printing. The printed paper can then be fed into the same folder is desired.

A general purpose and object of the present invention is to provide for alternative feeding of paper web either from a paper roll in a conventional unwind machine, or from a conventional box feeder provided alongside the unwind machine. Heretofore, one or the other of these two machines had to be located in alignment with the input end of the laser printer in order to function in the manner known in the prior art. The present invention provides an improved set-up whereby down time for the laser printer is significantly reduced from that normally required to replace one or the other of the unwind machine or the box feeder as required to set-up for printing upon paper webs of different source characteristics, that is, a roll of paper or a box of integrally connected perforated paper sheets.

SUMMARY OF THE INVENTION

In accordance with the present invention, two alternative sources of web paper; namely, a roll of paper and a box of folded perforated paper sheets can be fed into a high speed laser printer without requiring any relocation or repositioning of the box feeder or the unwind machine associated with feeding such paper web into laser printers generally.

The apparatus or system disclosed provides for feeding a paper web material into a high speed laser printer from either one of two alternative sources. One source being a paper roll and another source being a box of folded integrally connected perforated paper sheets. The apparatus includes a conventional unwind machine for rotatably supporting and driving the paper roll as required to feed a paper web into the inlet end of high speed laser printer. A folded paper feeder is provided alongside the unwind machine and is adapted to support at least one box of folded paper and serves to feed the perforated paper web from that box in a direction parallel to that of the paper web normally provided from the unwind machine to the laser printer.

Finally, a pair of angled rollers is provided for changing the direction of the paper web from the box feeder to align it with the direction or motion of the paper web from the unwind machine which remains in alignment with the laser printer.

Thus, the high speed laser printer is adapted to receive paper web to be printed from either the unwind machine or from the paper box feeder without requiring movement or repositioning of either the unwind machine or the box feeder.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE PREFERRED EMBODIMENT

Figure 1:
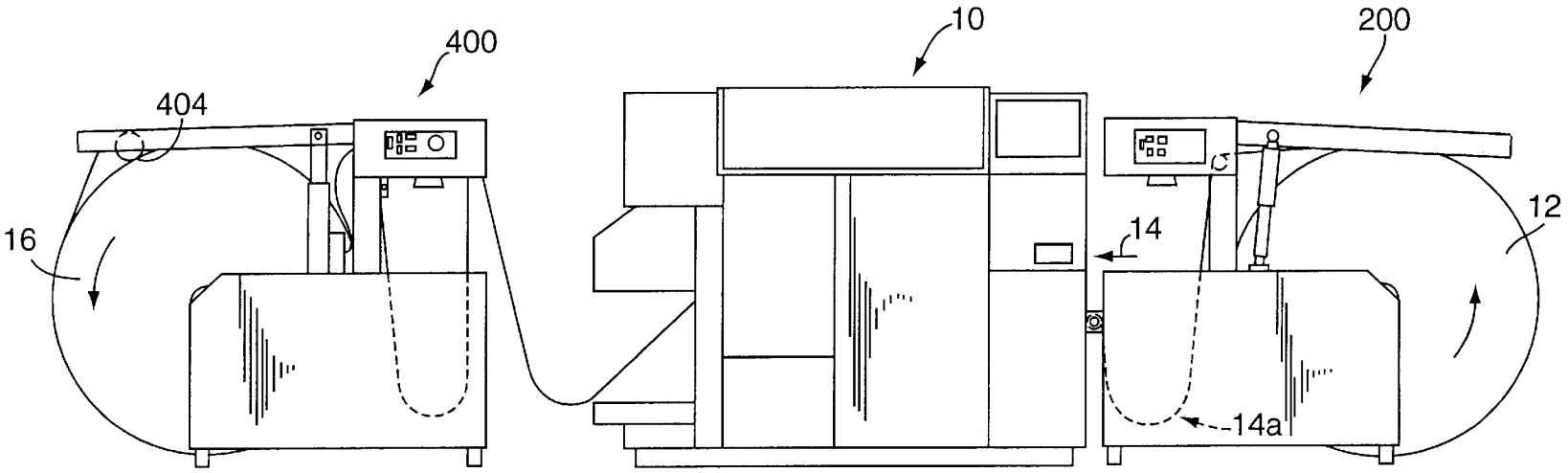
FIG. 1 PRIOR ART
FIG. 1 is an elevational view showing in schematic fashion the linear arrangement normally provided for feeding a paper web from an unwind machine through a laser printer onto a rewind machine.

Turning now to the drawings in greater detail, FIG. 1 shows a laser printer 10 which may be of the type manufactured by Siemens. Such laser printers are representative of modern day high speed laser printers generally and are designed to draw a web of paper into the printer at varying speeds. In fact, the paper web periodically stops and is rapidly accelerated from a stop in order to service such printers. Some printers actually provide for reversing the direction of web travel during a cleaning or maintenance phase or operation of the printer.

Figure 2:
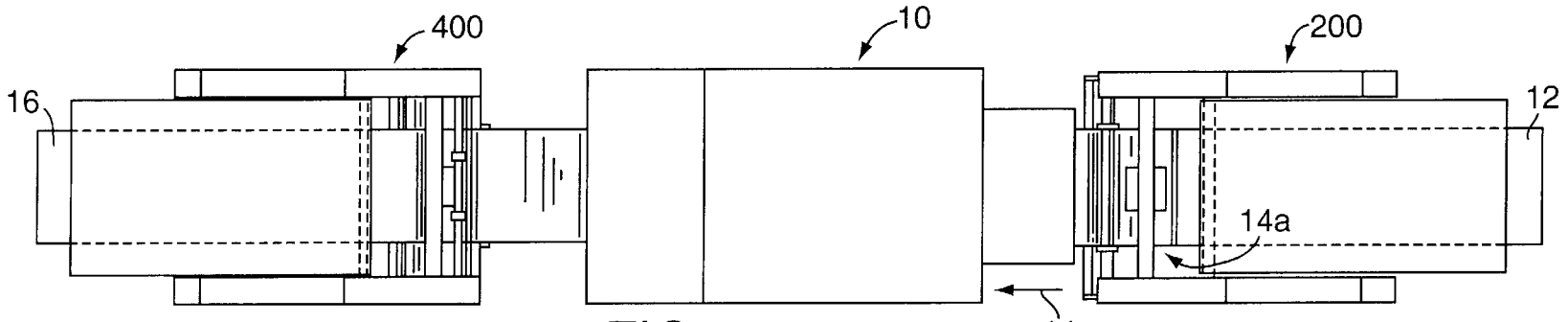
FIG. 2 PRIOR ART
FIG. 2 is a top plan view of the arrangement illustrated in FIG. 1.

As described in the above-identified application, Ser. No. 218,512 entitled MACHINE FOR MANIPULATING MATERIAL, the usual approach for feeding web material into and withdrawing web material from a laser printer generally takes the form of the set-up illustrated in FIGS. 1 and 2, wherein a paper roll 12 is rotatably supported in an unwind machine 200. The unwind machine includes means for rotating the paper roll 12 so as to feed the web of paper from the roll via a tension free loop 14*a,* from which loop the laser printer pulls the paper web as required and as indicated generally by the arrow 14 in FIG. 1. The set-up shown in FIGS. 1 and 2 is referred to as a "roll to roll" set-up, where the paper web material moves out of the printer through one or two tension free loops and across the top of a beam provided in the rewind machine 400 around a roll 404 that is driven and that serves to wind the printed web material on the rewind roll 16 as the rewind roll is rotated in the direction of the arrow shown.

Figure 3:
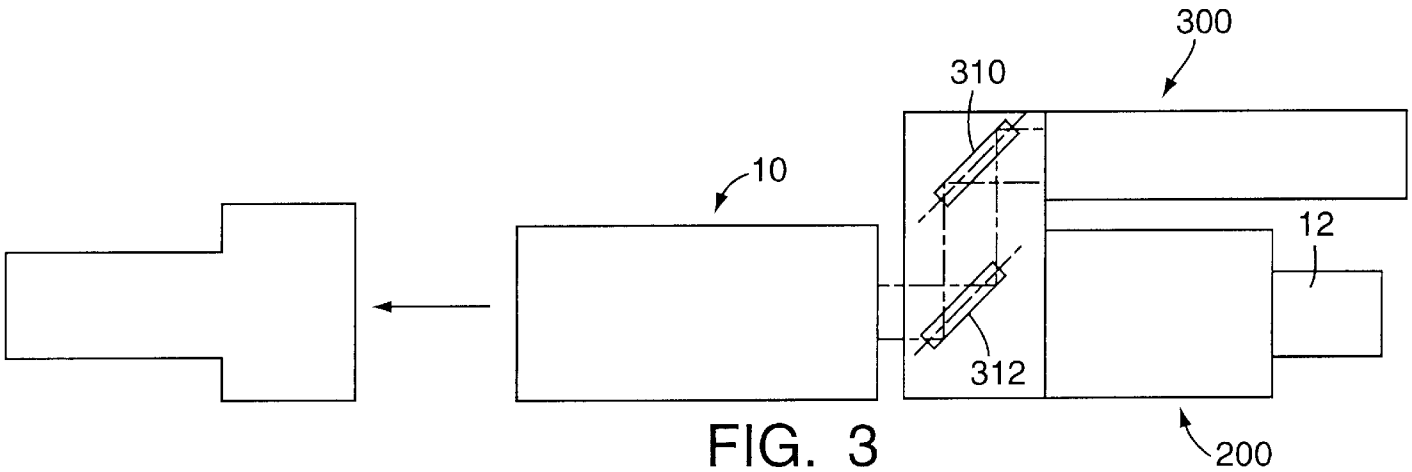
FIG. 3 is a top plan view of a laser printer which receives a paper web from an unwind machine that is aligned with the laser printer so as to allow the printing of the paper web in the same manner as disclosed in FIGS. 1 and 2. In addition, a box feeder is provided alongside the unwind machine, and angled rollers are illustrated to change the path of movement of the paper web from the box feeder to allow this perforated paper web to be fed into the laser printer without repositioning of the unwind machine and box feeder. A paper web folder is shown at the downstream end of the laser printer to illustrate that the paper web from either the unwind machine or the box feeder can be folded to be repackaged in boxes in accordance with conventional practice at the exit end of the laser printer.

In FIG. 3, an alternative set-up is illustrated at the downstream end of the laser printer such that the paper web is folded and deposited in boxes after having been printed upon by the laser printer. Such a folder can be used with a high speed laser printer that receives a paper web from a roll of the type illustrated generally at 12 in FIG. 3, or the paper web can instead be fed from a box feeder as indicated generally at 300 in FIG. 3.

Figure 4:
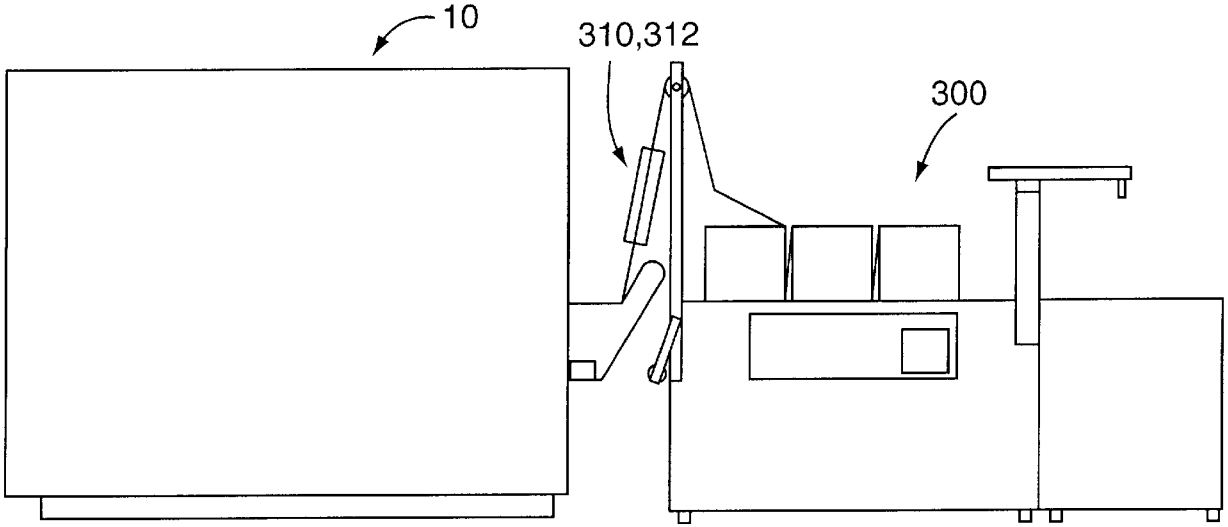
FIG. 4 is an elevational view of the set-up illustrated in FIG. 3, but without showing the unwind machine.

In accordance with the present invention, the box feeder 300 is capable of withdrawing folded paper web from a box or series of boxes and, utilizing the perforations at the sides or side of the paper web, to feed the paper web over a sprocket and into the printer as illustrated in greater detail in FIG. 4. In further accordance with the present invention, the path of this perforated paper web from the box feeder does not pass directly into the laser printer 10, but instead its path is redirected by angled rollers 310, 312 best shown in FIG. 3. These rollers provide for changing the direction of the perforated paper web from the box feeder 300 through successive 90° angles in order to provide a path for this perforated paper web into the printer 10 which in effect bypasses the unwind machine 200.

Alternatively, when the box feeder 300 is not being utilized to provide perforated paper web to the printer 10, the unwind machine can be conventionally operated to provide paper from an unwind roll in the unwind machine 200 all in accordance with the teaching of the above-identified application Ser. No. 218,512.

Obviously, modifications and variations of the above-described invention will occur in light of this disclosure. For example, one might provide the unwind machine off center from the laser printer and provide instead the box feeder in place of the location for the unwind machine in FIG. 3. The tension free loop must, however, be provided between the laser printer and the angled rollers rather than as part of the unwind machine itself. Such an arrangement would provide a less than satisfactory configuration for the overall system, but would nevertheless afford the print shop with an alternative that provides distinctive advantages over the present day requirement for repositioning the unwind machine, and/or the box feeder when changing over a job set-up from paper web fed from a roll to perforated paper web fed from a box.

The invention claimed is:

1. An apparatus for feeding paper web material into a high speed laser printer having internal web feed, said apparatus rendering said printer capable of receiving paper web from at least two alternative sources, one of said sources being a paper roll and another of said sources being a stack of integrally connected sheets provided in a rectangular box, said apparatus comprising:

an unwind machine for rotatably supporting and driving a paper roll as required to feed one paper web into the printer, a folded paper feeder alongside said unwind machine for supporting at least one box of folded paper, said printer internal web feed feeding that folded paper web from the one box in a direction parallel to that of the paper web fed from the unwind machine, a pair of angled rollers for changing the direction of said folded paper web to align it with the direction of said one paper web whereby the printer is adapted to receive paper web to be printed from either the unwind machine or the paper box without requiring either the unwind machine or the box of folded paper on said feeder to be physically moved, said high speed laser printer including means for intermittently feeding paper web into said printer, and said unwind machine supporting said paper roll including at least one tension-free loop for accommodating changes in the speed of the roll as dictated by changes in the speed of said internal laser printer web feed.

* * * * *